United States Patent [19]

Williams

[11] Patent Number: 4,499,843

[45] Date of Patent: Feb. 19, 1985

[54] STRUT STEERING AND RETRACTING APPARATUS

[75] Inventor: John W. Williams, Bellevue, Wash.

[73] Assignee: The Boeing Company, Seattle, Wash.

[21] Appl. No.: 298,133

[22] Filed: Aug. 31, 1981

[51] Int. Cl.[3] ..... B63B 1/28

[52] U.S. Cl. ..... 114/280; 114/144 R

[58] Field of Search ..... 440/53, 55–65; 114/273–282, 249, 250; 74/520, 527; 187/82–86, 92, 93; 188/40–41

[56] References Cited

U.S. PATENT DOCUMENTS

| | | | |
|---|---|---|---|
| 2,415,183 | 2/1947 | Law | 440/63 |
| 3,175,529 | 3/1965 | Bergstedt | 440/62 |
| 3,742,890 | 7/1973 | Hubbard et al. | 114/279 |
| 3,933,116 | 1/1976 | Adams et al. | 440/61 |

FOREIGN PATENT DOCUMENTS

| | | | |
|---|---|---|---|
| 1438289 | 4/1966 | France | 114/249 |
| 194923 | 6/1964 | Sweden | 114/250 |
| 483300 | 12/1975 | U.S.S.R. | 114/249 |

*Primary Examiner*—Trygve M. Blix
*Assistant Examiner*—Jesûs D. Sotelo
*Attorney, Agent, or Firm*—William C. Anderson

[57] ABSTRACT

A hydrofoil craft strut (365) steerable when the craft (5) is foil-borne and retractable when the strut (365) is not in use. In a preferred embodiment, the strut (365) is provided with a spherical bearing (185) disposed at the intersection of a steering axis (S—S) and a retraction axis (R—R). The bearing (185) allows a steering assembly (200) to steer the strut (365) about the steering axis (S—S). A downlock assembly (390) constrains the strut (365) in a vertical portion during the strut steering mode and releases the strut (365) during the retraction mode. During the retraction mode, a retraction assembly (385) rotates the strut (365) about the retraction axis (R—R) from its vertical position to a position within a recess (40) within the craft (5) in which it is fixed by an uplock assembly (715).

23 Claims, 19 Drawing Figures

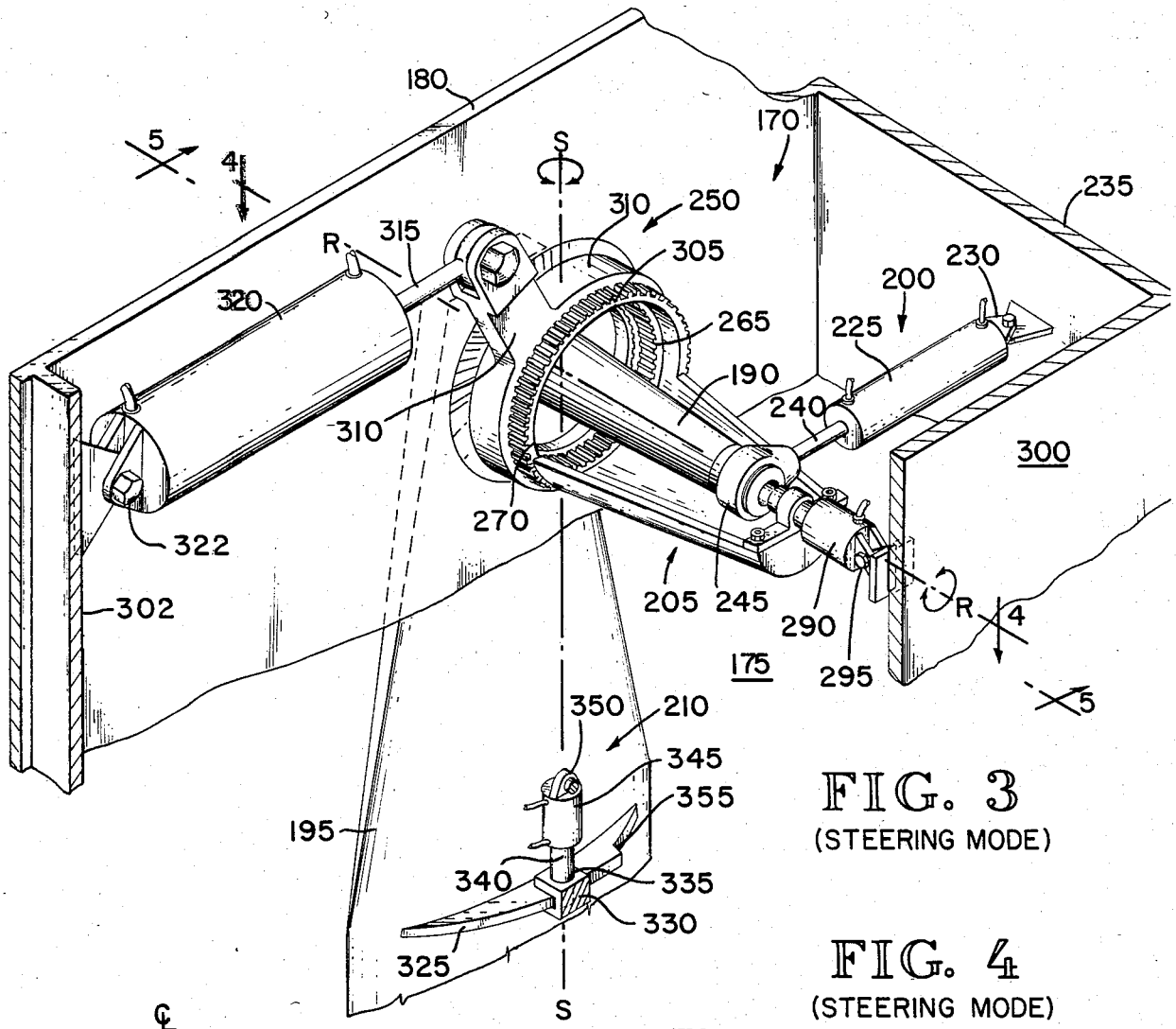
FIG. 3
(STEERING MODE)
FIG. 4
(STEERING MODE)
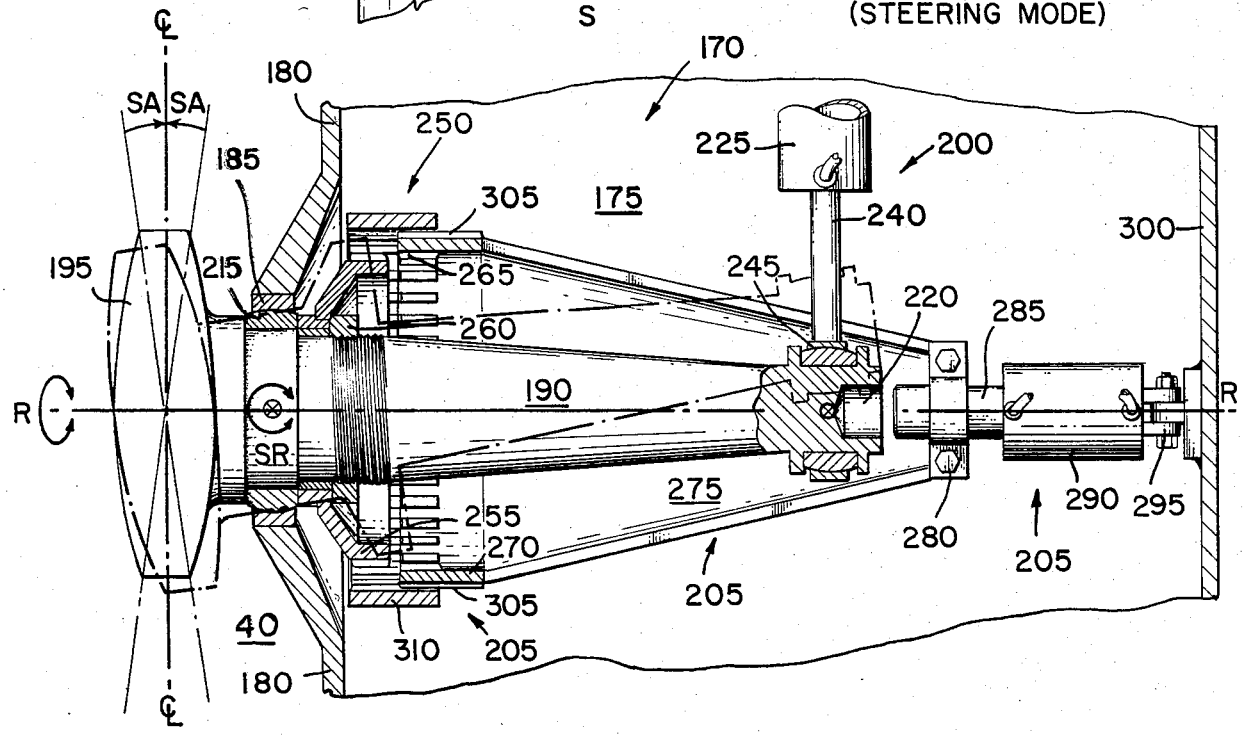

(STEERING MODE)

(RETRACT MODE)

(RETRACT MODE)

(STEERING MODE)

(RETRACT MODE)

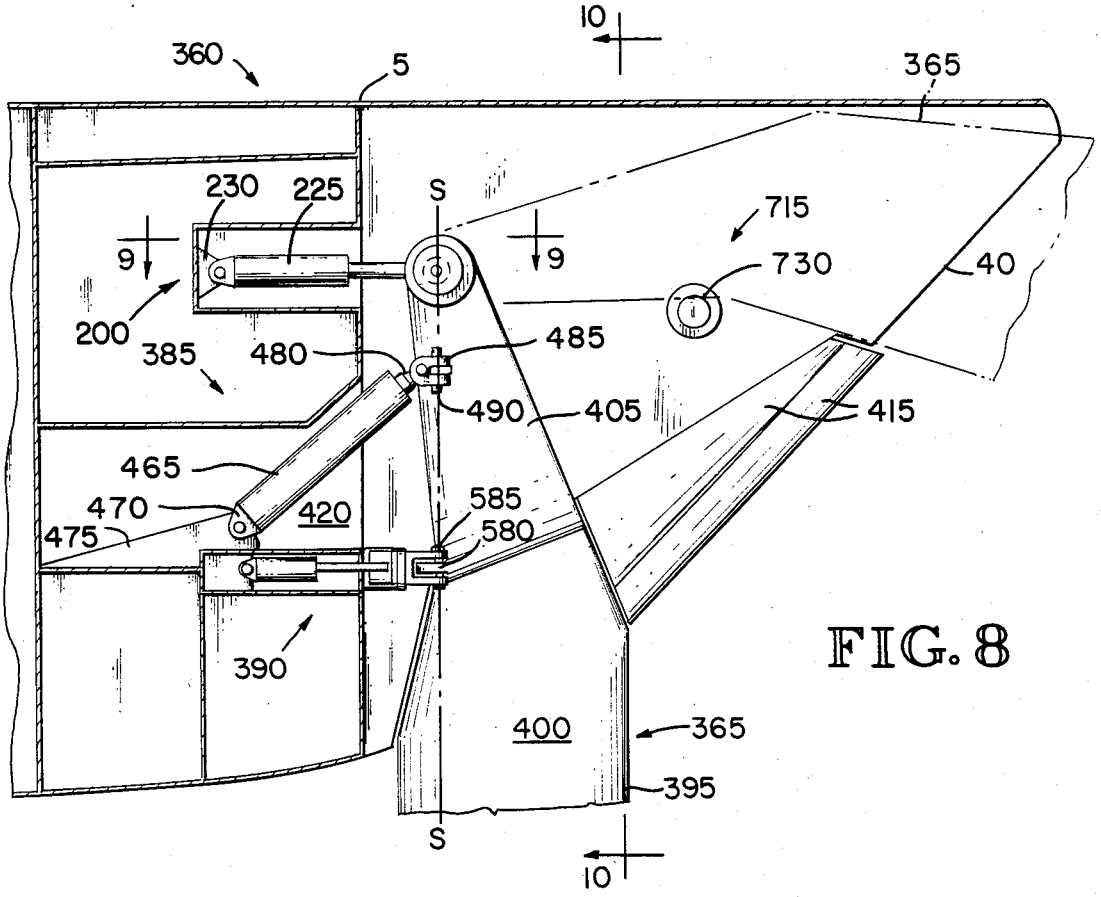
FIG. 8
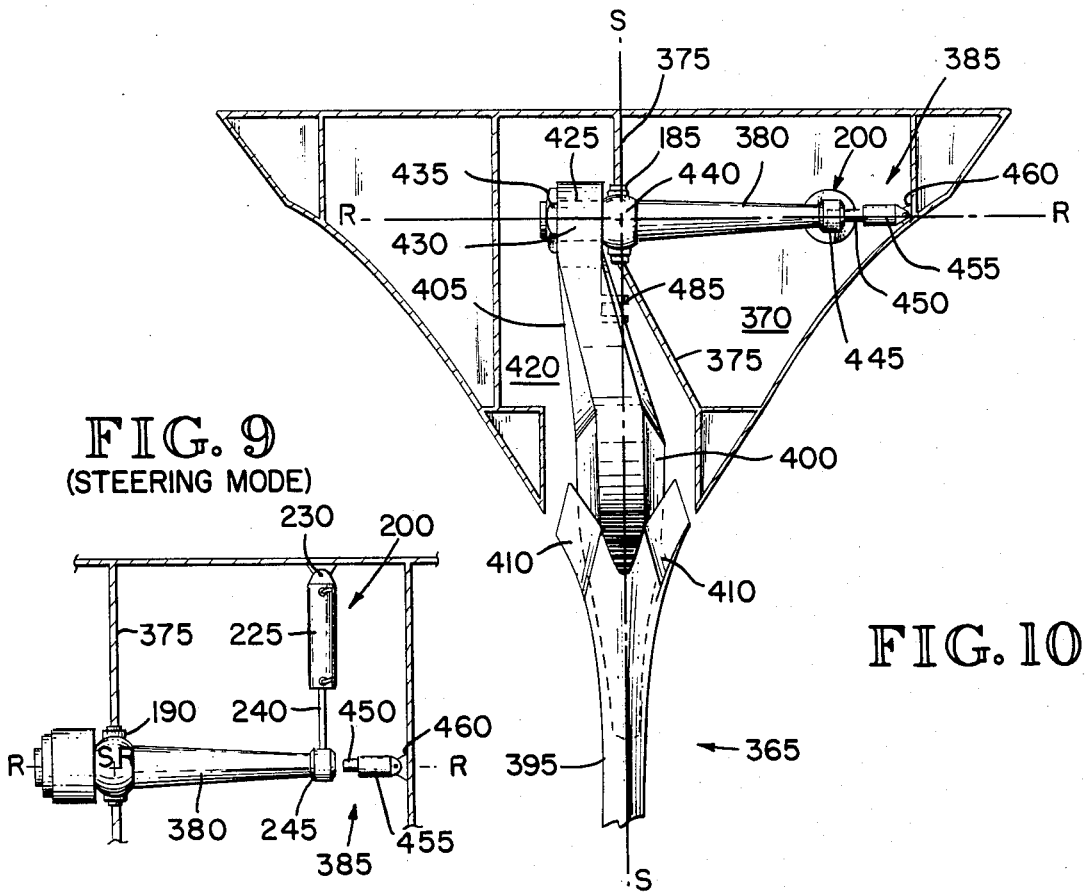
FIG. 9
(STEERING MODE)
FIG. 10

(RETRACT MODE)

(STEERING MODE)

(STEERING MODE)

STRUT STEERING AND RETRACTING APPARATUS

TECHNICAL FIELD

The present invention relates to steerable and retractable struts and more particularly relates to an apparatus for steering a hydrofoil craft using a strut of the craft wherein the strut may be retracted after use.

BACKGROUND OF THE INVENTION

Hydrofoil craft have foils which move through the water during flight, i.e., during foil-borne operation of the craft the foils develop lift comparable to an airplane wing. The foils are carried on steerable struts attached to the hull structure of the craft whereby the hull may be held clear of the water during flight maneuvers. The steerable struts are usually mounted on a structure permitting the struts to be retracted whereby the hull can float on the water and the craft is able to ride in a hull-borne mode comparable to a conventional ship.

BRIEF SUMMARY OF THE INVENTION

The present invention provides a strut steering and retracting apparatus for watercraft comprising a strut having a pivot axis and a transverse axis perpendicular to that axis. The strut is capable of being in an extended position whereby it may be pivoted about the pivot axis and in a retracted position after it has been rotated about the transverse axis. To enable the strut to be pivoted about the pivot axis and rotated about the transverse axis, a first spherical bearing is disposed at the intersection of the pivot and transverse axis. A pivoting means comprising a first fluid operable motor is coupled to an elongated member that is coupled to the strut. A second spherical bearing allows the first operable motor to follow the motion of the strut as it is being pivoted about the pivot axis. A rotating means, enabling the strut to be rotated about the transverse axis from the extended position to the retracted position, comprises a second fluid operable motor. The second motor has a reciprocable pin which is insertable within a receptacle formed within the free end of the elongated member. During the retraction mode of the present strut steering and retracting apparatus, the pin is inserted within the receptacle whereby the strut may be rotated to the retracted position.

The present invention also provides a lock assembly which, in the present invention, is capable of locking the strut in its extended position. The present lock assembly comprises a first arm having a bearing surface and a second arm having a bearing surface; both arms being pivotably mounted. Clamping means capable of holding said arms and means forcing the arms into contact with the clamping means and for maintaining said contact are provided. Finally, means releasing the arms from the hold of the clamping means is provided.

BRIEF DESCRIPTION OF THE DRAWINGS

The invention will be more fully understood from the following detailed description of an illustrative embodiment, taken in conjunction with the accompanying drawings, in which:

FIG. 3 is a perspective view of the portside of an embodiment of the strut steering and retracting apparatus of the present invention in a steering mode.

FIG. 4 is a partial planar view taken along line 4—4 in FIG. 3.

FIG. 8 is a starboard side view of a preferred embodiment of a steering and retracting apparatus of the present invention.

FIG. 9 is a simplified partial planar view taken along line 9—9 in FIG. 8.

FIG. 10 is a forward-to-aft view taken along line 10—10 in FIG. 8.

DETAILED DESCRIPTION OF THE INVENTION

Figure 1:
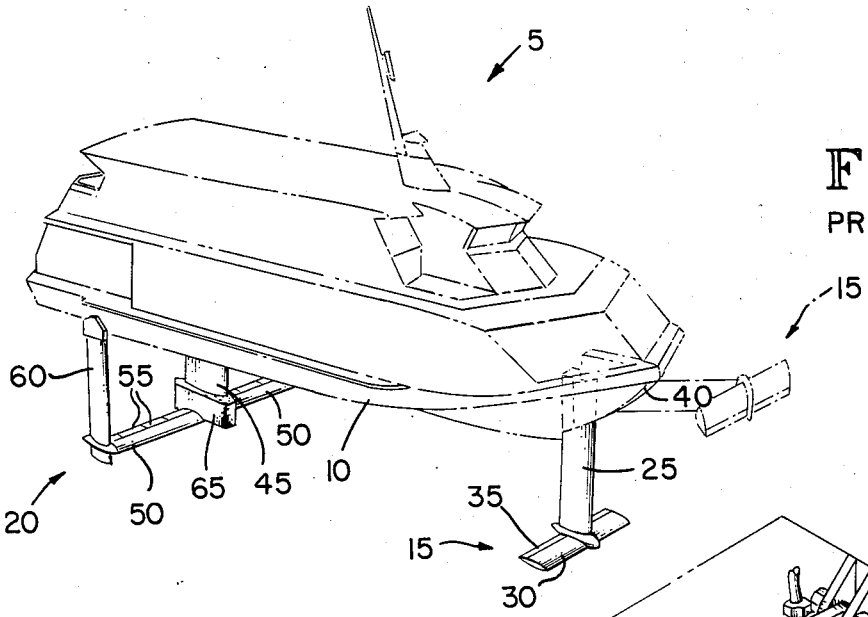
FIG. 1 PRIOR ART
FIG. 1 is a perspective view of the starboard side of a conventional hydrofoil craft with which the steering and retracting apparatus of the present invention may be employed.

Referring now to the following schematic drawings wherein like reference characters designate identical or corresponding parts throughout several views and more particularly to FIG. 1 showing a conventional hydrofoil craft 5. As illustrated in FIG. 1, the craft 5 has an appropriately configured hull structure 10 provided with a superstructure of any desired type (not described in detail since not a part of the present invention). The hydrofoil craft 5 is provided with a forward strut assembly 15 disposed in a cavity (only generally represented in FIG. 1) in the bow of the craft and an aft strut assembly 20 fastened near the stern of the craft.

The forward strut assembly 15 comprises a conventional steerable and retractable forward strut 25 carrying a forward foil 30 preferably having conventional control surfaces 35. A recess 40 is provided in the bow of the craft 5 allowing retraction of the forward strut 25.

The aft strut assembly 20 comprises a central aft strut 45 carrying an aft foil 50 provided with conventional control surfaces 55. An starboard outboard aft strut 60 and a port outboard aft strut (not shown) are pivotally attached to the hull structure 10 and pivotally fastened by a conventional means (not shown in detail) to the aft foil 50. Also attached to the central aft strut 45 is a center intake 65 for a conventional propulsion unit (not shown).

The struts 25, 45 and 60 are shown in FIG. 1 in their vertical or extended position for foil-borne operation in which the foils 30 and 50 move through the water developing sufficient lift to support the hull structure 10 at a desired distance above the water. The control surfaces 35 and 55 are utilized to control the position and motion of the craft and the forward strut 25 is steerable about its vertical axis thereby serving as a rudder. For hull-borne operation of the craft 5, the struts 25 and 45 are moved to retracted positions whereby the hull 10 floats on the water for operation as a conventional ship. During the hull-borne operation of the craft 5, the forward strut 25 pivotally moves towards the forward direction within the recess 40 in the bow of the craft to a retracted position (shown in phantom in FIG. 1) while the aft strut 45 moves towards a recess (not shown) within the stern (this position is not shown in FIG. 1).

Figure 2:
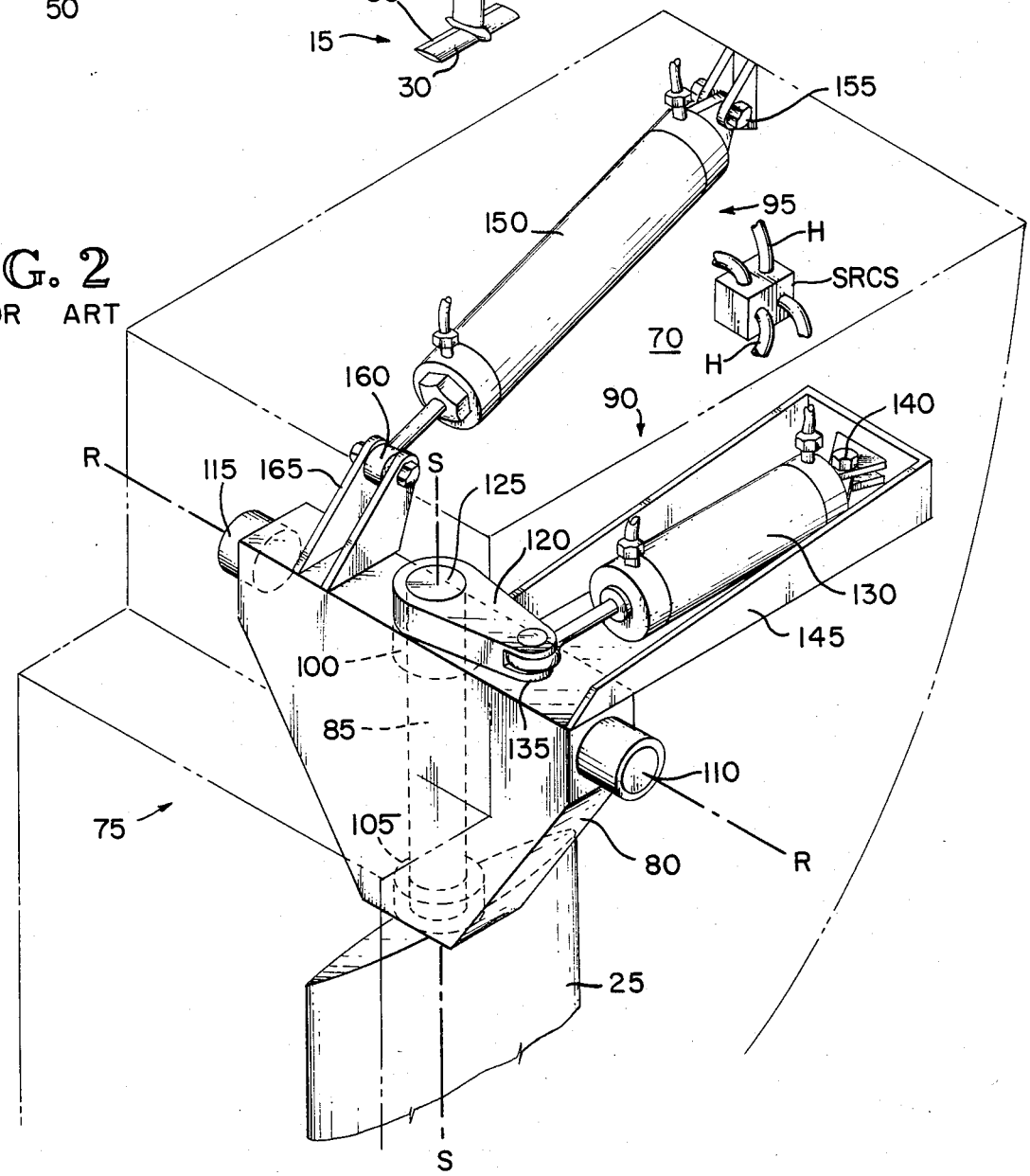
FIG. 2 PRIOR ART
FIG. 2 is a simplified partial perspective view of the portside of a conventional strut steering and retracting apparatus.

Referring now to FIG. 2, a conventional steering and retracting apparatus 75 is illustrated as being disposed in a cavity 70 that is located proximate to the bow of the craft 5 and exposed to the highly corrosive salt water environment proximate to the craft. The steering and retraction apparatus 75 comprises a yoke assembly 80 fitted about the king post 85 of the steerable and retractable forward strut 25, a steering assembly 90, a retraction assembly 95 and a steering and retraction control system, (SRCS).

The yoke assembly 80 comprises an upper steering bearing 100 and a lower steering bearing 105 supported by a structure (not shown) within the yoke assembly. The bearings 100 and 105 are adapted to allow rotation of the yoke assembly 80, about a pivot or a steering axis S—S aligned with the king post 85, and resist vertical loading imposed on the yoke assembly by the forward strut 25. A pair of trunnions 110, 115, aligned along a transverse retraction axis R—R, are disposed at opposite ends of the yoke assembly 80 and are fitted in bearings (shown generally) supported in the bulkheads (not shown) forming the bow cavity 70.

The steering assembly 90 comprises a steering arm 120 fastened to the upper portion 125 of the king post 85. A controllable fluid operable motor such as a double-acting hydraulic steering actuator 130, suitably connected to the steering and retraction control system (by means of, e.g., hydraulic hoses H, is respectively coupled by means of a pair of pins 135 and 140 to the steering arm 120 and a mounting member 145 forming an extension of the yoke assembly 80. The stroke of the piston rod of the actuator 130 and all actuators recited hereinafter is controllable over a wide range for a purpose which will become clear shortly.

The retraction assembly 95 comprises a controllable double-acting hydraulic retraction actuator 150 suitably connected to the steering and retraction control system (e.g., hydraulic hoses H). The actuator 150 is pinned as at 155 to a bulkhead forming a portion of the cavity 70 and at 160 to a retraction arm or a clevis 165 attached to the yoke assembly 80. A latching mechanism (not shown), suitably connected to the steering and retraction control system, vertically constrains the strut 25 during the strut steering mode.

During the steering mode, the latching mechanism (not shown) is actuated by the steering and retraction control system whereby the strut 25 is constrained for steering about the axis S—S. The steering actuator 130 is actuated by the control system whereby the steering arm 120 is pivoted about the axis S—S and steering of the forward strut 25 is effectuated. For retraction, the control system causes the latching mechanism to release the strut and actuates the hydraulic retraction actuator 150 that applies a moment through the retraction arm 165 about the retraction axis R—R. The moment developed by the retraction assembly 95 effects retraction of the forward strut 25 within the recess 40.

The conventional steering and retracting apparatus 75 suffers from many disadvantages. For example, the apparatus 75 incurs high steering forces caused by the presence of high friction within the bearings 100, 105. The friction is caused by the fact that these bearings are loaded against each other during assembly in an attempt to eliminate any lost motion. Another disadvantage is that the apparatus 75 is complex and requires rigorous and complicated manufacturing relationships between the many parts of the apparatus, e.g., the strut 25, the yoke assembly 80 and the craft 5. These relationships include close tolerances, alignments, pin ups, etc. A further disadvantage is that the cavity 70 must be large to accomodate the apparatus 75. Furthermore, this cavity is exposed to the corrosion inducing salt water environment proximate to the craft 5. Additionally, the design of bow doors (not shown in FIG. 1) must be complex due to the structural configuration of the apparatus 75. Finally, the steering and retraction apparatus 75 is extremely heavy reducing the load-carrying capability of the hydrofoil craft 5.

The present invention attempts to either eliminate or ameliorate the problems recited above. An embodiment of the present invention is illustrated in FIG. 3 in which a steering and retracting apparatus 170 is shown as being disposable in a dry cavity 175 formed in part by a bulkhead 180. The cavity 175 is isolated from the salt water environment surrounding the hydrofoil craft 5. The bulk head 180 supports a spherical bearing 185 (see FIG. 4) cooperating with an elongated member or a steering and retracting trunnion 190 coupled at one end to a steerable and retractable forward strut 195 and at its other end to a steering assembly 200. The bearing 185 is disposed at the intersection (SR, i.e., pivot point) of the pivot or steering axis S—S and the transverse retraction axis R—R of the apparatus 170. The apparatus 170 also comprises a retraction assembly 205 and a steering lock assembly 210.

The steering and retracting trunnion 190 is alignable with the retraction axis R—R and is provided at one end with a bearing surface 215 which cooperates with the spherical bearing 185. The other end of the trunnion is provided with a socket 220 cooperating with a portion of the retraction assembly 205, as will be better understood hereinafter.

The steering assembly 200 comprises a controllable double-acting hydraulic steering actuator 225 connected by means of a pivotable pin 230 to a bulkhead 235 forming a part of the dry cavity 175. The piston rod 240 of the actuator 225 is fastened by means of a spherical bearing 245 (see FIG. 4) to the other end of the trunnion 190. The spherical bearing 245 permits sufficient freedom of motion for the actuator 225 whereby the trunnion 190 may be pivoted about the point SR.

The retraction assembly 205 comprises a retraction clutch assembly 250 including a torque transmitting member 255 that is splined to the trunnion 190 and held in place by a retainer 260. The torque transmitting member 255 is connectable by means of a conventional spline coupling 265 to a slideable retraction collar 270. The collar 270 is connected, by a suitable means, to at least one plate 275 which is disposed below (and/or above) the trunnion 190 (see FIG. 5). The connecting plate 275 is fastened by means of a conventional clamping coupling 280 to a reciprocable retraction hinge pin 285 of a controllable double-acting hydraulic retraction hinge pin actuator 290. The actuator 290 is attached, by means of a pivotable pin 295, to a bulkhead 300 forming another portion of the dry cavity 180. The hinge pin 285 fits within the socket 220 of the trunnion 190 whereby the trunnion 190 may be rotated about the retraction axis R—R during a strut retraction mode.

The slideable retraction collar 270 of the retraction clutch assembly 250 is provided with an outer spline 305 capable of cooperating with a retraction arm 310 having an inner spline. The retraction arm 310 is appropriately pinned to the piston rod 315 of a controllable double-acting hydraulic retraction actuator 320 fastened as at 322 to the hull structure 302 forming a portion of the dry cavity 180.

A bearing surface 325 is provided on a portion of the strut 195 which cooperates with the steering lock assembly 210. The steering lock assembly comprises a clevis 330 attached to the bulkhead 180 (see FIG. 5). The clevis 330 has a hole 335 as does the bearing surface 325 (represented in FIG. 6) permitting the passage of a rod 340 of a controllable double-acting hydraulic lock and hinge pin actuator 345 attachable by means of a pin 350 to the bulkhead 180 (see FIG. 5). The hole in the bearing surface 325, the hole 335, the rod 340 and the actuator 345 are in alignment with the vertical steering axis S—S during the steering mode of the steering and retracting apparatus 170 whereby the strut 195 may be fixed in its extended position and pivoted about the axis S—S.

Figure 5:
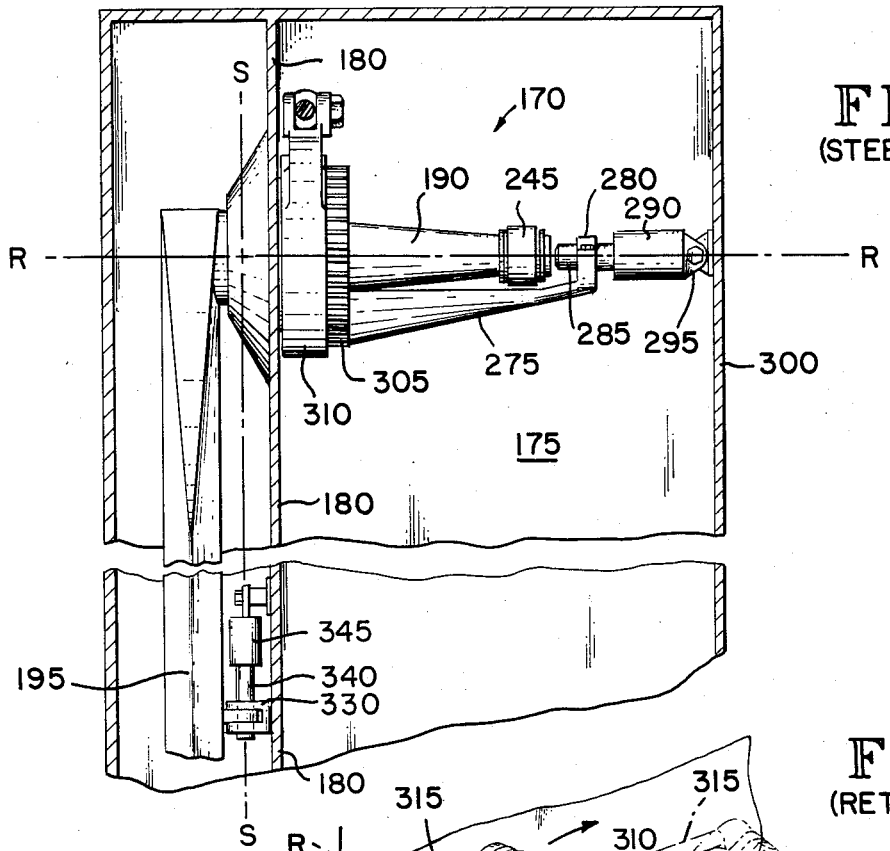
FIG. 5 is a forward-to-aft view taken along line 5—5 in FIG. 3.
Figure 6:
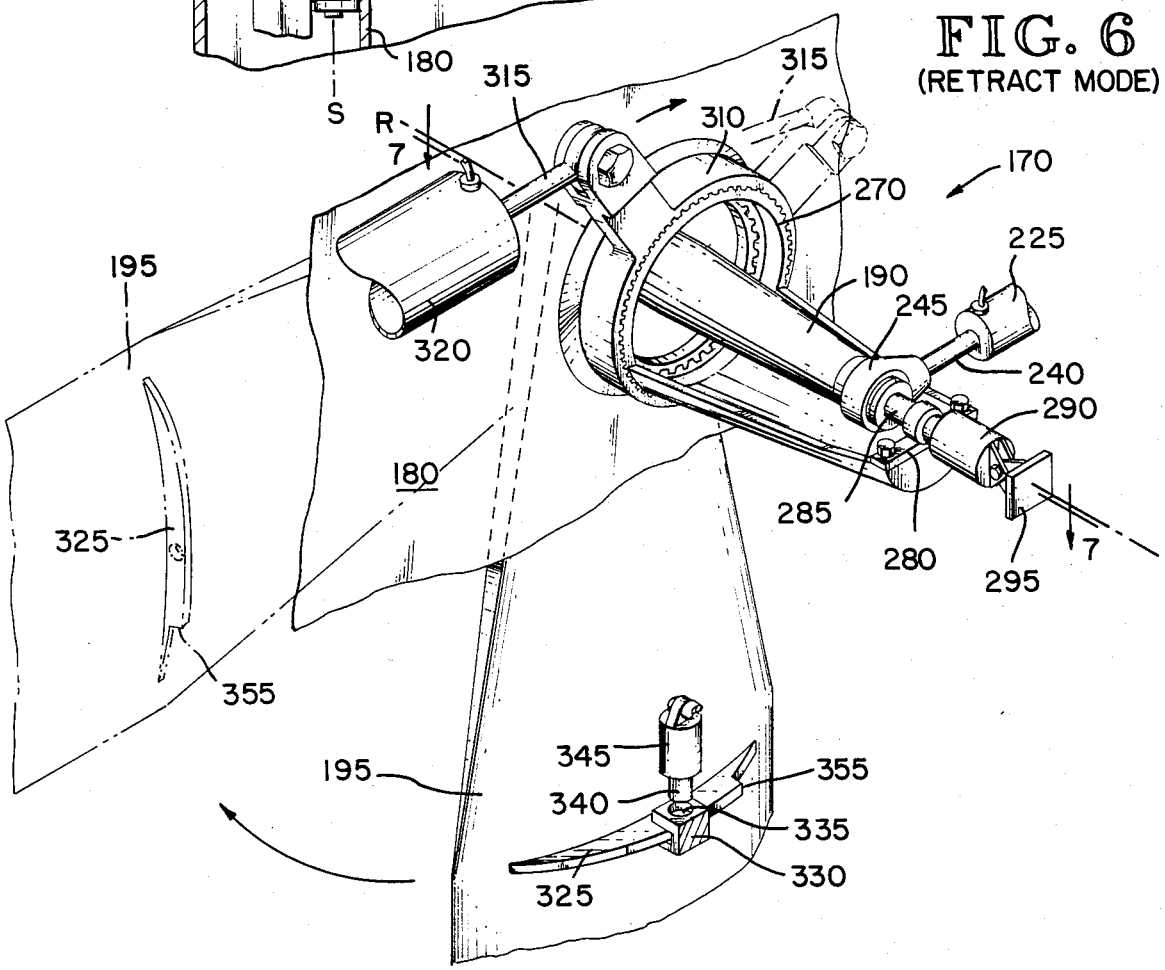
FIG. 6 is a partial perspective view, with parts broken away, of the embodiment of FIG. 3 in a retract mode.

During the steering mode of the apparatus 170, a steering and retraction controller (not shown) but comparable to the SRCS schematically depicted in FIG. 2 actuates the retraction hinge pin actuator 290 causing the removal of the pin 285 from within the socket 220, i.e., the pin 285 is moved from left to right as viewed in FIGS. 4 and 5. Concomitantly, the plate 275 moves from left to right pulling the slideable retraction collar 270 to the right whereby the spline connection 265 between the collar 270 and the torque transmitting member 255 is eliminated. During the steering mode, the lock and hinge pin actuator 345 is also activated by the controller whereby the rod 340 is fitted within the hole 335 of the clevis 330 and the hole in the bearing surface 325 (see FIG. 5). With the retraction assembly clutch 250 disengaged, the controller can actuate the steering actuator 225 which is capable of pivoting the trunnion 190, and consequently the strut 195, about the pivot point SR. When the trunnion 190 is pivoted by the actuator member 225, the torque transmitting member 255 will also be pivoted, as is shown in phantom FIG. 4, but will not engage the collar 270, whereby the strut may be readily steered through a strut angle SA.

Figure 7:
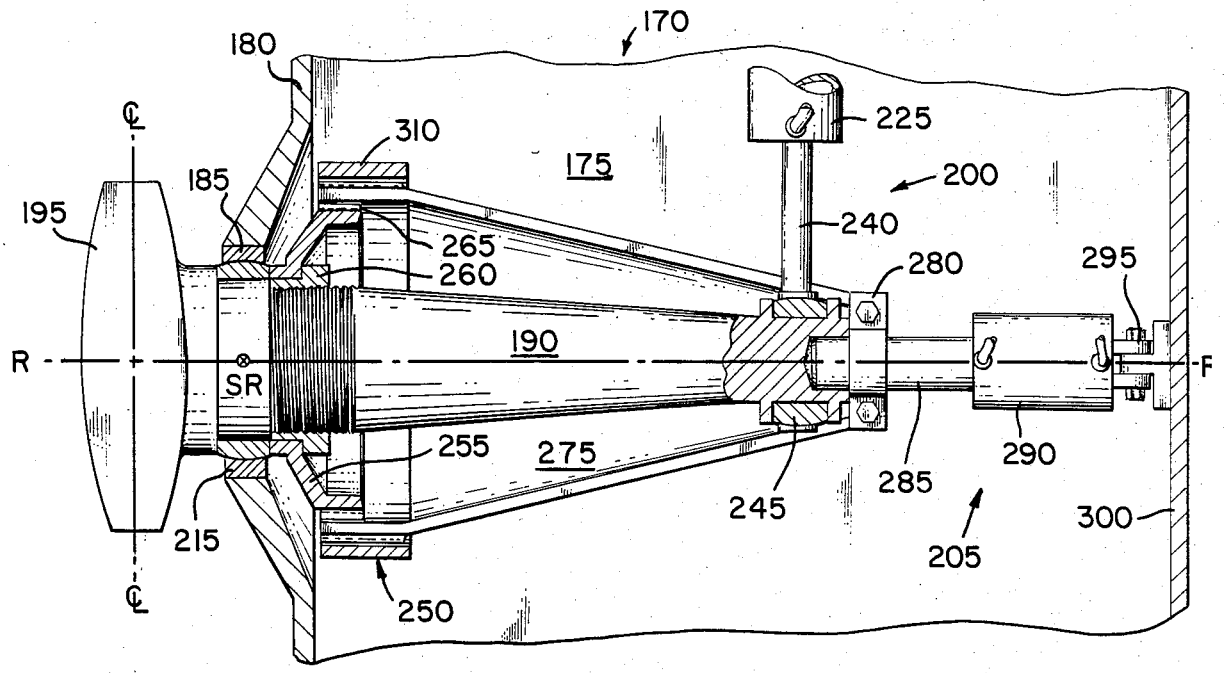
FIG. 7 is a planar view taken along line 7—7 in FIG. 6.

Upon initation of the retraction mode by the controller, the actuator 225 places the strut 195 in a null position where the strut angle, SA, relative to the center line, CL, (see FIG. 7) of the craft 5 is zero and the trunnion 190 is aligned with the axis R—R. The controller then activates the actuator 290 which inserts the pin 285 within the socket 220 whereby the slideable retraction collar 270 is placed into a cooperating relationship with the torque transmitting member 255 and the retraction arm 310 (see FIG. 6). The controller also sends a signal to the lock and hinge pin actuator 345 which withdraws the rod 340 from within the hole in the bearing surface 325 and the hole 335 in the clevis 330. When appropriate, the controller causes the retraction actuator 320 to apply a moment about the axis R—R, utilizing the retraction arm 310, whereby the strut 175 may be rotated or retracted about the axis R—R from a vertical position to a retracted position (partial retraction shown in phantom in FIG. 6) within the recess 40. An up lock mechanism (not shown) cooperates with an up lock indentation 355 formed on the bearing surface 325 whereby the strut 175 may be fixably positioned within the recess 40.

A second and more preferred embodiment of a steering and retraction apparatus 360 of the present invention is illustrated, beginning with FIG. 8, as being attached to a forward steerable and retractable strut 365. The apparatus 360 is substantially disposed in a dry cavity or a compartment 370 located near the bow of the craft 5. As shown in FIG. 10, the compartment 370 comprises a longitudinal bulkhead 375 supporting the spherical bearing 185 located at the intersection of the vertical steering axis S—S and the transverse retraction axis R—R. The apparatus 360 comprises the spherical bearing 185, a steering and retracting trunnion 380, the steering assembly 200, a retraction assembly 385 and a down lock assembly 390.

As can be generally seen in FIG. 10, the forward strut 365 has a substantially trapezoidal cross-section and is provided with a lower portion 395, a transition section 400 and an upward portion 405. The lower portion 395 is aligned with the steering axis S—S as is the transition section 400. The upward portion 405 is skewed relative to the steering axis S—S and relative to the retraction axis R—R. A pair of fairings 410 are attached to the transition section 400 and cooperate with bow doors 415 in order to reduce the amount of sea water entering a sea compartment 420 within which the forward strut 365 is disposed.

A bore 425 is provided in the upper portion 405 of the strut 365 allowing a mounting stem 430 of the trunnion 380 to engage an attachment nut 435 thereby affixing the forward strut 365 to the trunnion 380. As with the trunnion 190, the trunnion 380 is provided with a bearing surface 440 cooperating with the spherical bearing 185. The trunnion 380 is also provided with a socket 445 at its free end comparable to the socket 220. The steering assembly 200 cooperates with the trunnion 380 by means of the spherical bearing 245 as described earlier.

The retraction assembly 385 comprises a retraction hinge pin 450 of a controllable double-acting hydraulic retraction hinge pin actuator 455 pinned as at 460 to hull structure within the compartment 370. The hinge pin 450 is insertable within the socket 445 during the strut retraction mode as described earlier.

The retraction assembly 385 also comprises a controllable double-acting hydraulic retraction actuator 465 pinned as at 470 to hull structure 475 disposed in the sea compartment 420. The retraction actuator 465 is connected by means of its piston rod 480 to a clevis 485 pinned as at 490 to the upper portion 405 of the strut 365. The pin 490 lies along the steering axis S—S whereby the retraction actuator 465 may follow any motion of the steerable and retractable forward strut 365.

Figure 11:
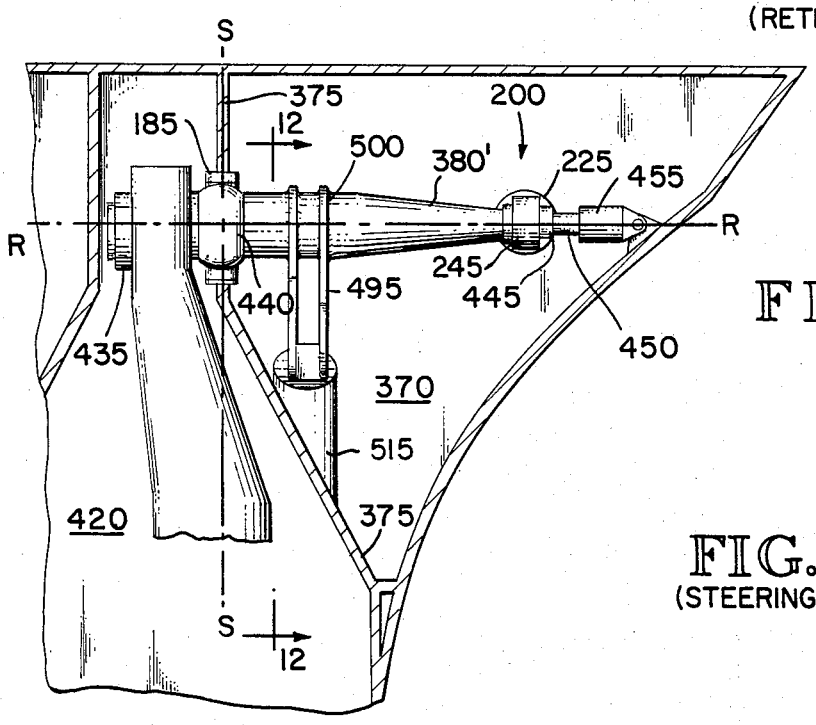
FIG. 11 is a partial fore-to-aft view of a modified, preferred version of the retraction actuator assembly.
Figure 12:
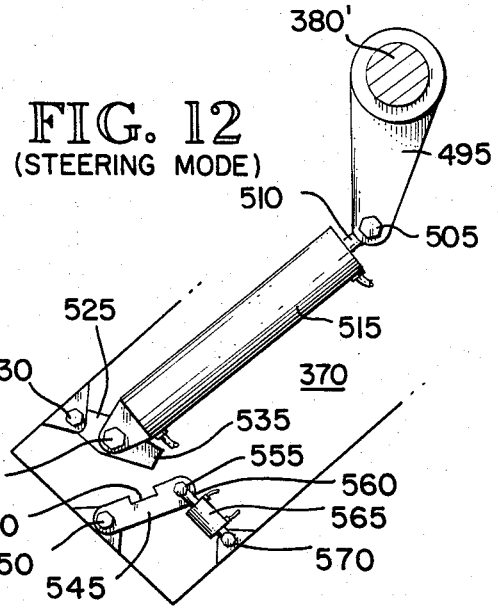
FIG. 12 is a partial side view taken along line 12—12 in FIG. 11 during a steering mode.
Figure 13:
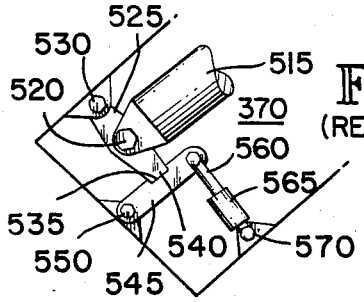
FIG. 13 is a partial side view showing a portion of the retract actuator assembly of FIG. 12 during a retraction mode.

An alternative and more preferred form of the retraction assembly is shown in FIGS. 11 to 13. Referring now to FIG. 11, the hinge pin 450 of the controllable double-acting hydraulic retractable hinge pin actuator 455 is shown proximate the free end of a trunnion 380'. A retraction arm or a lever 495 is attached as at 500 to the trunnion 380' intermediate the spherical bearing 185 and the end of the trunnion 380'. The lever 495 is attached by means of a spherical bearing 505 to the piston rod 510 of a controllable double-acting hydraulic retraction actuator 515 pinned as at 520 to a swingable link 525. The swingable link 525 is pinned as at 530 to the hull structure within the dry compartment 370 and has a latchable surface or an end 535 capable of engaging a notch 540 of a latch link 545 during the retraction mode of the retraction assembly (see FIG. 13). The latch link 545 is pinned as at 550 to the hull structure within the cavity 370 and at 555 to the piston rod 560 of a controllable double-acting hydraulic latch link actuator 565 pinned as at 570 to the hull structure within the compartment 370. During the steering mode the latch link actuator 565 disengages the latch link 545 from the swingable link 525 (see FIG. 12) allowing the trunnion 380' to be steered by the steering assembly 200. Of course, during the steering mode, the hinge pin 450 is also retracted by the hydraulic actuator 455 freeing the trunnion 380'. The retraction assembly of FIGS. 11–13 is preferred because it is capable of being positioned completely within the dry compartment 370 and is consequently sealed off from the sea water environment.

Figure 14:
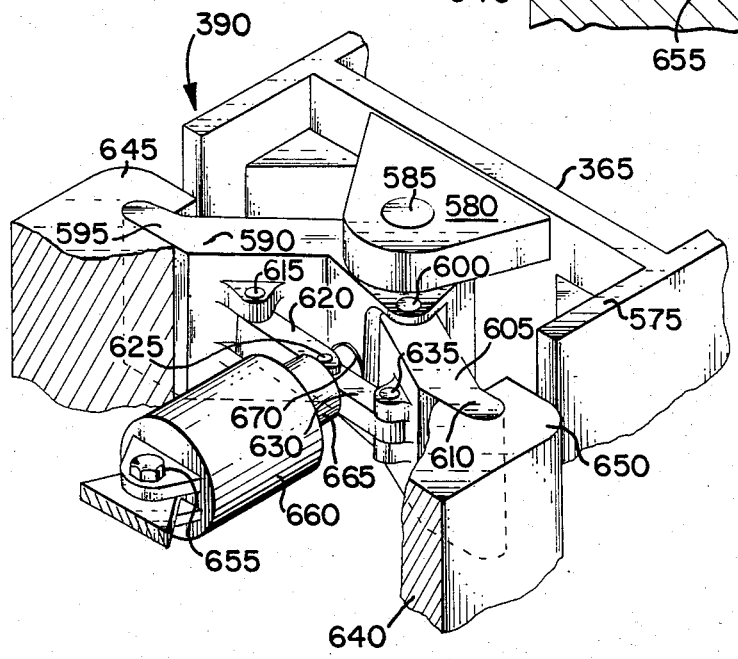
FIG. 14 is a partial perspective view from the starboard side of the downlock assembly illustrated in FIG. 8.

In either the embodiment of FIG. 8 or FIG. 11, a down lock mount 575 is formed proximate the transition section 400 of the strut 365 (see FIG. 14). A clevis 580 is attached to the down lock mount 575 and is fastened as by a pin 585 to the down lock assembly 390. The pin 585 is aligned with the steering axis S—S whereby the down lock assembly 390 may guide the motion of the steerable and retractable strut 365 during the steering mode while ensuring that the strut 365 remains in an extended position.

The down lock assembly 390 comprises a releasable port support arm 590 having a bearing surface 595 pinned as at 600 to a releasable starboard support arm 605 that is provided with a bearing surface 610. Pivotally mounted by a pin 615 to the port support arm 590 is a port lockable link 620 pinned as at 625 to a starboard lockable link 630 pivotally mounted as at 635 to the starboard support arm 605. A latch support fitting 640, attached to the hull structure 475, is provided with an integral port latch member 645 and an integral starboard latch member 650. The members 645, 650 engage and cooperate with the bearing surfaces 595 and 610 during the steering mode, as will be understood.

Figure 16:
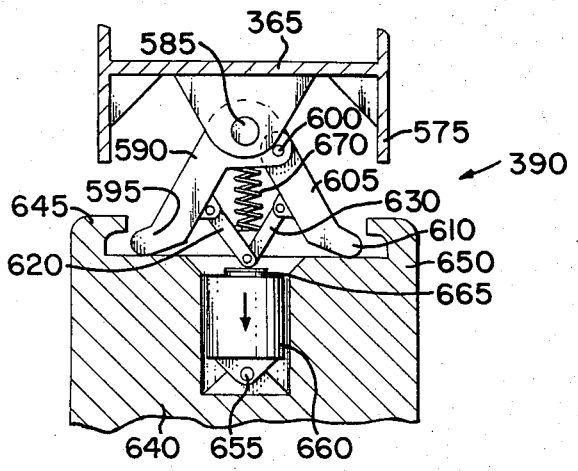
FIGS. 15 and 16 are planar views illustrating the operation of the downlock assembly of FIG. 14 during the strut steering and retract modes, respectively.
Figure 15:
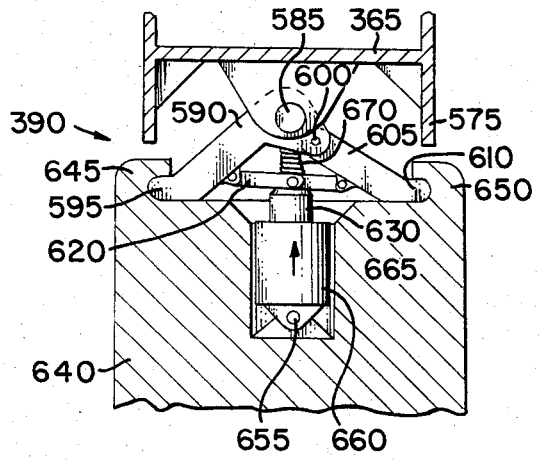

Hingedly mounted, as at 655 is, a controllable double-acting hydraulic latch actuator 660 provided with a piston rod 665. During the steering mode, the steering and retraction controller activates the latch actuator 660 causing the piston 665 to abuttingly engage and force the locking links 620 and 630 towards the position shown in FIGS. 14 and 15 whereby the bearing surfaces 595 and 610 are forced into an engagement with the latch members 645 and 650 and held therebetween. Concomitantly, a spring 670, suitably attached to the locking link 620, is compressed. In this mode, the forward strut 365 is fixed in its extended or vertical position whereby the strut 365 may be steered about the axis S—S by the controllable steering actuator 225 under the influence of the steering and retraction controller. During the retract mode, the controller causes the latch actuator 660 to retract the piston rod 665 from its abutting relationship with the locking links 620, 630 (see FIG. 16). The spring 670 concomitantly forces the locking links 620, 630 back into the position shown in FIG. 16. Consequently, the bearing surfaces 595, 610 are released from their engagement with the latch members 645, 650 and the strut 365 may be retracted about the axis R—R within the recess 40 by means of the retraction assembly of FIGS. 8 or 11 when activated by the controller.

Figure 19:
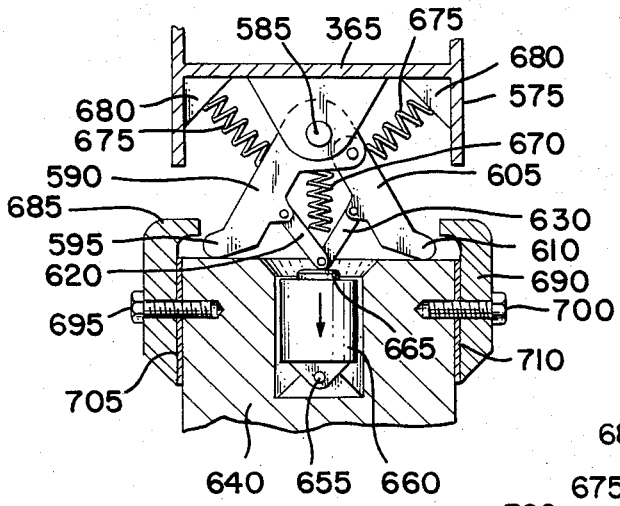
FIGS. 18 and 19 are planar views illustrating the operation of the downlock assembly of FIG. 17 during the strut steering and retract modes, respectively.
Figure 18:
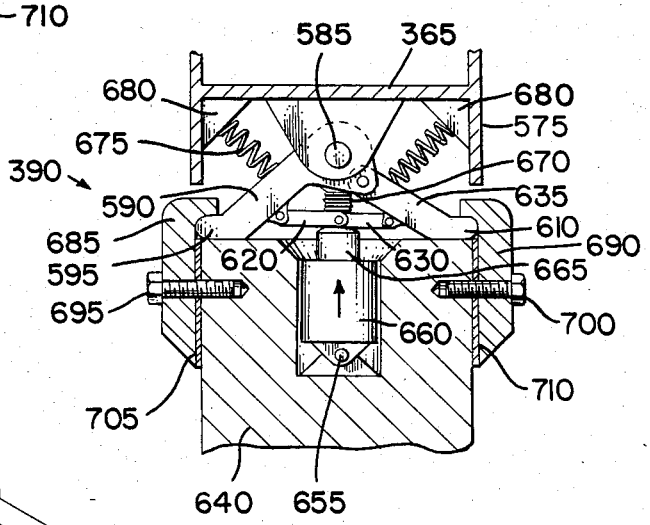
Figure 17:
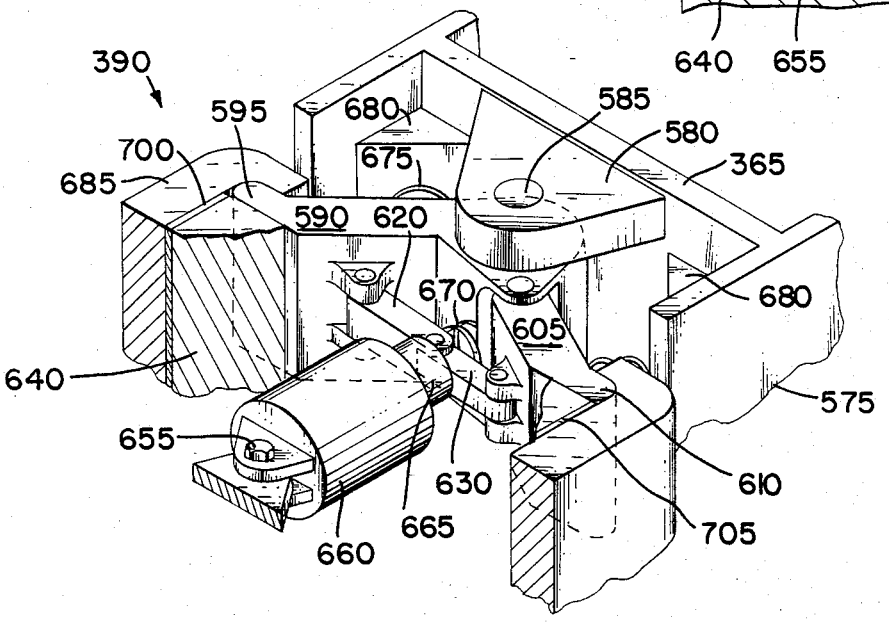
FIG. 17 is a partial perspective view from the starboard side of a modified version of a downlock assembly.

The operation of an alternative embodiment of the down lock assembly 390 is shown in FIGS. 17 through 19 wherein a pair of biasing springs 675, mounted by means of spring mounts 680 to the down lock mount 575 on the strut 365, are added. The springs 675 cooperate with the spring 670 to cause the disengagement of the bearing surfaces 595, 610 from a pair of adjustable latch members 685, 690 during a retraction mode. The latch members 685, 690 are adjustable by means of adjustment bolts 695, 700 and shims 705, 710.

During a retraction mode, the controller activates the retraction assembly of FIGS. 8 or 11 and the downlock assembly of FIGS. 11 or 17 causing the steerable and retractable strut 365 to rotate about the retraction axis R—R from a steerable position shown in solid lines in FIG. 8 to the retracted position shown in phantom in that same figure. During a retraction mode, the bow doors 415 are opened by the controller and the strut 365 is rotated to within the recess 40 disposed in the bow of the craft 5. An up lock assembly 715 comprising a controllable double-acting hydraulic up lock actuator (not shown in detail) is actuated by the controller whereby its piston rod 730 is forced under the strut 365 thereby supporting the strut (see FIG. 8).

While there has been described what is at present considered to be the preferred embodiments of this invention it will be obvious to those skilled in the art that there are changes and modifications that may be made therein without departing from the true spirit and scope of the invention and it is therefore intended to cover all such changes and modifications as set forth in the appended claims.

What is claimed and desired to be secured by Letters Patent of the United States is:

1. A lock assembly, comprising:

a first arm having a bearing surface, a second arm having a bearing surface, said second arm being pivotably mounted to said first arm;

means for pivotably mounting said arms, clamping means capable of holding each of said arm bearing surfaces, said clamping means comprising a first latch member capable of clamping said first arm bearing surface, a second latch member capable of clamping said second arm bearing surface, and means for supporting said latch members;

means forcing said arms into contact with said clamping means, said forcing means comprising a first lockable link pivotably mounted to said first arm, a second lockable link pivotably mounted at one of its ends to said first link and at its other end to said second arm, and means capable of applying a force along a single direction at the point where said second link is pivotably mounted to said first link, and means releasing said arm bearing surfaces from the hold of said clamping means.

2. The lock assembly of claim 1, comprising:

means for adjusting the position of said first and second latch members relative to said support means.

3. The lock assembly of claim 1, wherein said link force means comprises a fluid operable motor, said motor having a reciprocable piston capable of contacting said links.

4. The lock assembly of claim 1, wherein said releasing means comprises a first compressible spring disposed between said lockable links and said arms.

5. The lock assembly of claim 4, wherein said releasing means further comprises a second compressible spring disposed between said arm mounting means and said first arm and a third compressible spring disposed between said arm mounting means and said second arm.

6. Strut steering and retracting apparatus for a watercraft, comprising:

a strut having a pivot axis and a transverse axis perpendicular to said pivot axis; said strut being capable of being in an extended position, whereby it may be pivoted about said pivot axis, and in a retracted position, after it has been rotated about said transverse axis, means forming a first spherical bearing disposed at the intersection of said pivot and said transverse axes, means for pivoting said strut about said pivot axis when said strut is in said extended position, means for rotating said strut about said transverse axis from said extended position to said retracted position, an integral elongated member coupled to said strut and to said pivoting means; said elongated member having a free end, said pivoting means comprising a first fluid operable motor coupled to said elongated member by means of a second spherical bearing, and said rotating means comprising a second fluid operable motor; said second motor having a reciprocable pin; said elongated member having a receptacle formed at said free end; said reciprocable pin being insertable within said receptacle, whereby said strut may be supported and rotated to said retracted position.

7. Apparatus as in claim 6, further comprising means for vertically constraining said strut and allowing said strut to be pivoted about said pivot axis when said strut is in said extended position.

8. Apparatus as in claim 7, wherein said rotating means further comprises a third fluid operable motor, said third motor having a piston rod, said third motor piston rod being pivotably coupled to a first moment arm, said first moment arm being fixedly attached to said elongated member and releasable means for constraining the motion of said third motor about said transverse axis.

9. Apparatus as in claim 8, wherein said releasable third motor constraining means comprises a swingable link member pivotably attached to said third motor, said swingable link having a latchable surface and a pivotably mounted end; a latching link having a pivotably mounted end and a notch capable of engaging said latchable surface, the other end of said latching link being pivotally connected to a fourth fluid operable motor, and means for pivotably mounting said fourth motor.

10. Apparatus as in claim 9, further comprising means for holding said strut in a fixed position after it has been rotated about said transverse axis into a retracted position.

11. Apparatus as in claim 10, further comprising means for controlling said pivoting means, said rotating means, said constraining means and said retracted strut holding means.

12. Apparatus as in claim 7, wherein said rotating means comprises a torque transmitting member, said torque transmitting member being fixed to said elongated member, a second moment arm, a fifth fluid operable motor, said fifth motor being pivotably coupled to said second moment arm, and reciprocable means for coupling said torque transmitting member to said second moment arm.

13. Apparatus as in claim 12, wherein said reciprocable coupling means comprises a first spline on said second moment arm, a second spline on said torque transmitting member and a slidable collar capable of being inserted between said first and second splines, said slidable collar having a third spline capable of cooperating with said first spline and a fourth spline capable of cooperating with said second spline, and means for inserting said collar between said first and second splines.

14. Apparatus as in claim 13, wherein said inserting means comprises at least one connecting plate coupled to said slidable collar, said connecting plate being fixedly connected to said reciprocable pin.

15. Apparatus as in claim 12, wherein said constraining means comprises a bearing surface mounted on such strut and having a first passageway, a fixedly mounted clevis having a second passageway, and a seventh fluid operable motor provided with a reciprocable pin insertable in said first and second passageways.

16. Apparatus as in claims 7 or 9 or 14, wherein said constraining means comprises releasable bearing surface means pivotably mounted on said strut, means capable of engaging and holding said bearing surface means, and means for forcing said bearing surface means to be engaged and held by said engaging and holding means and means for releasing said bearing surface means from an engagement with said engaging and holding means.

17. Apparatus as in claim 16, wherein said releasable bearing surface means comprises a first and a second releasable bearing surface, said second releasable bearing surface being pivotally mounted to said first releasable bearing surface.

18. Apparatus as in claim 17, wherein said engaging and holding means comprises a first and a second latch member cooperating with said first and second releasable bearing surfaces respectively.

19. Apparatus as in claim 18, wherein said forcing means comprises a first and second lockable link, said first lockable link being pivotable mounted to said first bearing surface, said second lockable link being pivotally mounted to both said first lockable link and said second bearing surface, and a sixth fluid operable motor, said sixth motor having a reciprocable pin capable of abuttingly engaging said first and second lockable links.

20. Apparatus as in claim 19, wherein said bearing surface releasing means comprises a first compressible spring, said first spring being positioned between said releasable bearing surfaces and said lockable links, whereby when the pin of said sixth motor engages said lockable links, said first spring is compressed.

21. Apparatus as in claim 20, wherein said bearing surface releasing means further comprises a second and third compressible spring disposed between said strut and said releasable bearing surface means, whereby when the pin of said sixth motor engages said lockable links, said second and third springs are compressed.

22. Apparatus as in claim 21, comprising means for adjusting said engaging and holding means.

23. Apparatus as in claim 6, wherein said rotating means further comprises an eighth fluid operable motor having a mountable portion and a reciprocable rod, said eighth motor being pivotably mounted at said portion, and means for pivotably coupling the rod of said eighth motor to said strut to allow the rotation of said strut to a retracted position.

* * * * *